United States Patent [19]

Orban

[11] 3,980,828

[45] Sept. 14, 1976

[54] REVERBERATION SYSTEM WITH EXTENDED FREQUENCY RESPONSE

[75] Inventor: Robert A. Orban, Menlo Park, Calif.

[73] Assignee: Kurt Orban Company, Menlo Park, Calif.

[22] Filed: Oct. 3, 1975

[21] Appl. No.: 619,258

[52] U.S. Cl. ..... 179/1 J

[51] Int. Cl.[2] ..... H04R 3/00

[58] Field of Search ..... 179/1 J; 333/30 R, 29 R

[56] References Cited

UNITED STATES PATENTS

| | | | |
|---|---|---|---|
| 3,189,686 | 6/1965 | Brombaugh | 179/1 J |
| 3,492,425 | 1/1970 | Evans | 179/1 J |
| 3,587,006 | 6/1971 | Weingartner | 179/1 J |
| 3,624,266 | 11/1971 | Sharp | 179/1 J |

*Primary Examiner*—Kathleen H. Claffy
*Assistant Examiner*—E. Matt Kemeny
*Attorney, Agent, or Firm*—Blakely, Sokoloff, Taylor & Zafman

[57] ABSTRACT

A reverberation system which employs low cost, spring reverberators and obtains a frequency response to beyond 9kHz. The high frequency components of an input signal are frequency shifted, to a lower range, applied to a reverberator, and then frequency shifted to their original range. This signal is then summed with the output of a second reverberator which receives the lower frequency components of the input signal.

15 Claims, 5 Drawing Figures

REVERBERATION SYSTEM WITH EXTENDED FREQUENCY RESPONSE

BACKGROUND OF THE INVENTION

1. Field of the Invention

The invention relates to the field of reverberators and reverberation systems.

2. Prior Art

Reverberators, particularly mechanical, spring reverberators have been utilized for furnishing artificial reverberations to a sound signal from a recorder, radio, musical instrument, or other type of devices. The purpose of this reverberation is to simulate the reverberation effect of a room or hall, of appropriate acoustical properties within a relatively small listening space. Spring reverberators, such as those disclosed in U.S. Pat. No. 2,982,819 and 3,106,610 have been successfully used for this purpose and provide a relatively low cost reverberation means when compared to echo chambers, or the like. These reverberators generally consist of pairs of springs with slightly different time delays, driven in a torsional mode by a transducer. One major drawback to these spring reverberators is that they have a relatively low cutoff frequency of approximately 5kHz.

Because of certain inherent characteristics of these spring reverberators, it has been impractical to extend the frequency range of these devices. One reason for this is that the frequency cutoff beyond 4.5kHz is extremely rapid. Also, the decay time of the reverberations (i.e. the time in seconds necessary for the sound to decay from its steady state value to 60db below that value, after excitation is removed) becomes unsatisfactorily short. Moreover, these reverberations exhibit subjectively unpleasant coloration above 5kHz.

As will be seen the present invention utilizes two spring reverberators; however, through use of frequency shifting the range of the reverberations are extended to beyond 9kHz. This is accomplished utilizing standard, commercially available components.

SUMMARY OF THE INVENTION

The present invention discloses a system for utilizing a pair of reverberators to extend the frequency range associated with such reverberators to substantially beyond their normal range. The input signal is applied to one such reverberator (low frequency path) in an ordinary manner known in the art. The input signal is also passed through a highpass filter to remove the low frequency components, that is, the components approximately below 4.5kHz. The output of this highpass filter is then frequency shifted, downwardly by approximately 4kHz. In the presently preferred embodiment this frequency shifting is accomplished through use of a single-sideband (amplitude modulated) technique. The signal, once shifted in frequency, is then applied to a spring reverberator which operates in a normal manner. The output of this reverberator is frequency shifted, upwardly, again utilizing a single-sideband technique. This upwardly frequency shifted signal is then filtered to remove the carrier frequency associated with the single-sideband signal, and also to remove other undesirable frequency components, and then summed with the signal on the low frequency path.

It is an object of the present invention to provide a reverberation system which has extended frequency response; however, which employs relatively low cost reverberators.

DETAILED DESCRIPTION OF THE INVENTION

A reverberation system is disclosed which utilizes commercially available, spring type reverberators; however, which extends the frequency response of these reverberators to in excess of 9kHz.

Figure 1:
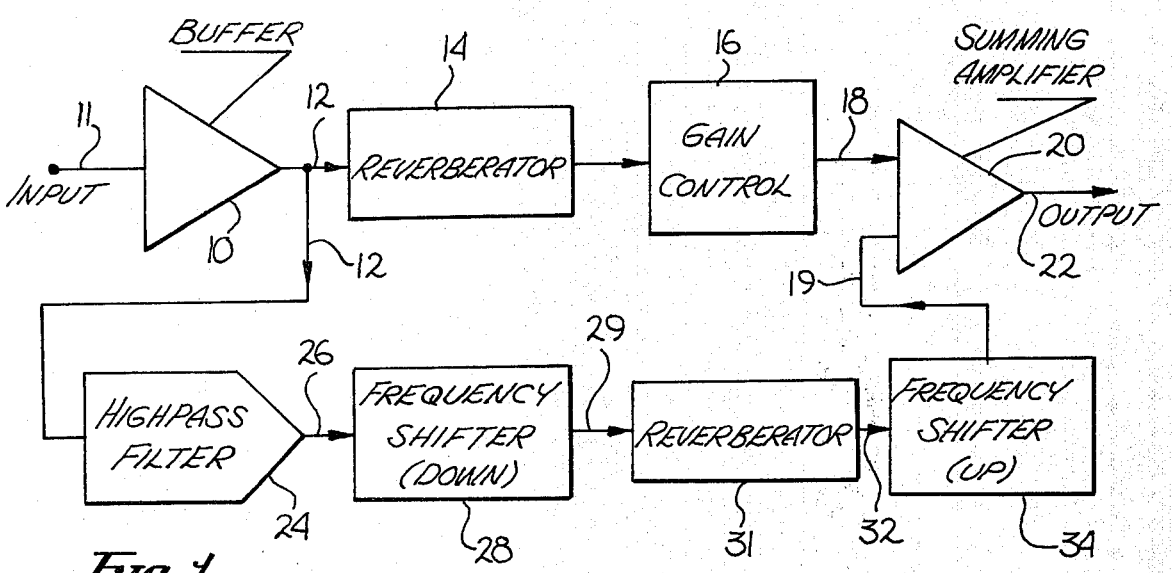
FIG. 1 is an overall block diagram of the presently invented reverberation system.

Referring first to FIG. 1, an input signal such as that representing music from a recorder, radio, record player, musical instrument, or the like, is applied to the input line 11 of a buffer 10. The output of the system is shown as line 22, which output is applied to appropriate speakers. The output of buffer 10 is applied to two paths; the low frequency path comprises reverberator 14 and gain control means 16, and the high frequency path includes filter 24, frequency shifters 28 and 34, and reverberator 31.

In the low frequency path the output of buffer 10, line 12, is applied to a reverberator 14; it will, of course, be appreciated that where the input signal is of sufficient strength, the buffer 10 may not be required. The output of the reverberator 14 is coupled through a gain control means 16, via line 18, to one input terminal of a summing amplifier 20. In the presently preferred embodiment, reverberator 14 comprises a spring-like reverberator such as shown in U.S. Pat. No. 2,982,819 and 3,106,610. Such reverberators include a driving and pickup amplifier, in addition to an electromechanical reverberation device often comprising a pair of springs having different time delays, driven in a torsional mode by a dynamic transducer. In the presently preferred embodiment, four springs are coupled in pairs, in a tandem arrangement, for reverberator 14. The reverberator 14 also includes equalization means to produce the desired frequency response. The gain control means 16 may be an ordinary gain control, such as a rheostat.

In the high frequency path, the buffer 10 is coupled to highpass filter 24 by line 12. The highpass filter 24, in the presently preferred embodiment, comprises a filter having a substantially flat response (within 2db) above 4.5kHz and provides attenuation of at least 69db below 3.6kHz. As will be seen, this high performance of filter 24 is desirable since the output of this filter is frequency shifted downwardly by approximately 4kHz frequency; frequency components shifted below zero frequency will "fold around" zero, and will not be restored upon upward shifting, thus causing objectionable distortion. In the presently preferred embodiment, highpass filter 24 comprises a 7th order, elliptical approximation, which may be realized utilizing known design techniques with an LC network, or with an active RC network.

The output of the highpass filter 24 is applied to the input of a frequency shifter 28. Frequency shifter 28 may be any one of a plurality of known means for shifting a signal to a lower frequency range. As will be discussed in conjunction with FIG. 2, in the presently preferred embodiment, a single-sideband amplitude modulation technique is utilized for shifting the frequency range. The frequency shifter 28 as presently implemented shifts the frequency of the input signal, downwardly, by approximately 4kHz.

The output of frequency shifter 28, line 29, is applied to reverberator 31. The reverberator 31 may be similar to reverberator 14; however, as presently preferred, reverberator 31 includes two springs, rather than the four springs utilized in reverberator 14. Also, reverberator 31 includes a 500Hz filter (shown separately in FIG. 2) for the purpose of eliminating the hum and microphonic pickup associated with the reverberator itself. This filter also eliminates the frequencies below 500Hz which are shifted downwardly to that range by the frequency shifter 28.

The output of reverberator 31, line 32, is applied to the input terminal of frequency shifter 34. Frequency shifter 34 may be any one of a plurality of known means for shifting frequencies (upwardly) to a higher range. As will be discussed in conjunction with FIG. 2, the shifter 34 utilizes a single-sideband technique for shifting frequency. The frequency shifter 34 is used to restore the signal applied to its input to its original frequency range, and hence shifts the signal upwardly by 4kHz.

The output of the frequency shifter 34 is applied to the other input terminal of summing amplifier 20, via line 19. Within the summing amplifier 20 the signals on lines 18 and 19 (the low frequency path and high frequency path) are summed and applied to the output line 22.

During operation of the system of FIG. 1 an input signal is applied to buffer 10 on line 11. Typically, frequencies below 100Hz are not applied to the system since in artificial reverberators the response to these low frequencies tends to be "muddy" or "boomy". The signal applied to reverberator 14 is operated upon by the reverberator in a normal manner, and the output after passing through gain control means 16 is applied to the summing amplifier. Because of the sharp cutoff characteristics of reverberator 14, the higher frequencies, that is, those frequencies above approximately 4.5kHz, are greatly attenuated and substantially unnoticeable.

The input signal in the high frequency path after passing through the highpass filter 24 substantially comprises the higher frequency components of the input signal, and in particular the frequencies above 4.5kHz. However, only frequencies between 4.5kHz and 9kHz shall be considered since frequencies above 9kHz (after being shifted to a lower range) are greatly attenuated by reverberator 31. Within the frequency shifter 28 this frequency band is shifted down, to a band of approximately 500Hz to 5kHz. This frequency range is suitable for driving the reverberator 31. The output of the reverberator 31 is then shifted upwardly to its original frequency range by the frequency shifter 34, and then summed within summing amplifier 20 with the signal on the low frequency path. Through use of gain control means 16 a desired balance may be obtained between the high and low frequency paths. It will be appreciated that the gain control means 16 may be placed in line 19 allowing gain control of the signal in the high frequency path, rather than in the low frequency path. Thus, the output of the summing amplifier 20 includes reverberations over a frequency range of approximately 100Hz to 9.0kHz. It should be mentioned that the system of FIG. 1 is possible since reverberation is substantially a linear operation, and does not introduce new frequencies into the reverberated signal. Thus, the reverberations of reverberator 31 in the high frequency path is equivalent to reverberations produced within reverberator 14; however, an extended frequency response is obtained through frequency shifting.

Figure 2:
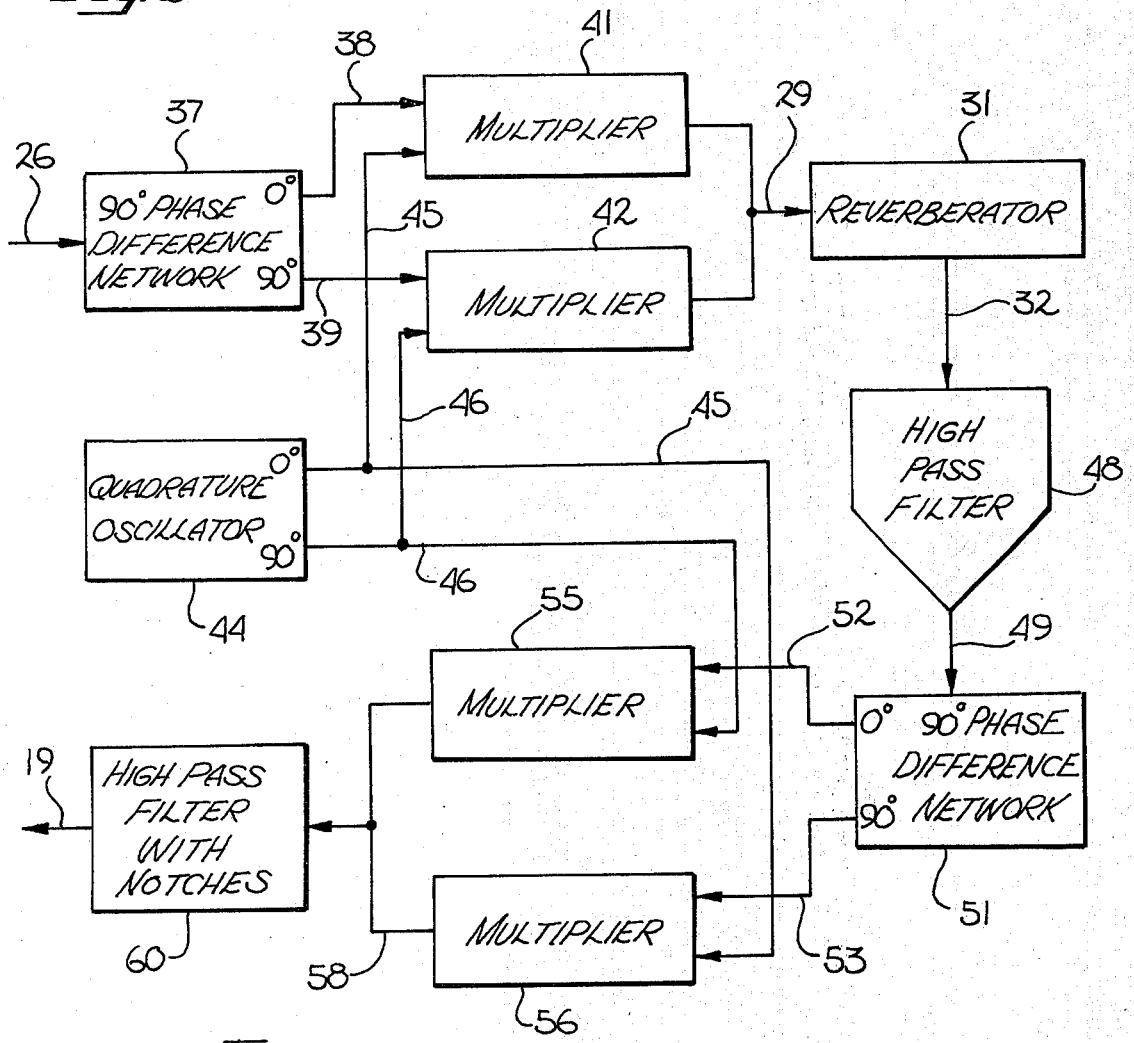
FIG. 2 is a block diagram of the portion of the system of FIG. 1 in which the high frequency components of the input signal are frequency shifted.

Referring now to FIG. 2, the portion of the high frequency path which includes the frequency shifter 28, reverberator 31 and frequency shifter 34 of FIG. 1 is shown in a detail block diagram. The output of the highpass filter 24, line 26 of FIG. 1, is shown as the input to a 90° phase difference network 37 in FIG. 2. The output of the frequency shifter 34 of FIG. 1, line 19, is shown as the output of the highpass filter with notches 60 of FIG. 2. The frequency shifting technique and means used in the circuitry illustrated in FIG. 2 shifts frequencies either to a higher or lower range by the generation of a single-sideband, amplitude modulated, signal. For a general discussion of this technique, described in conjunction with a transmission system, see *Information Transmission, Modulation and Noise,* by Mischa Schwartz, published by McGraw Hill (1959, pgs. 106 & 107).

The 90° phase difference network 37 may be any one of a plurality of known circuits for providing two sources of an input signal, one of said sources being shifted is phase by 90° relative to the other source, in the frequency range of 4.5 to 10kHz. The input signal on line 26 appears on line 38 with a first or 0° phase shift, and on line 39 with a 90° phase shift relative to the signal on line 38.

Multipliers 41 and 42, as well as multipliers 55 and 56, may be any of a plurality of known circuit means, such as integrated circuit means, for multiplying two signals and for producing a signal representative of the product of these signals. Multiplier 41 multiplies the signal on line 38 by the signal on line 45; the product, or output, of multiplier 41 is applied to line 29. Similarly, multiplier 42 multiplies the signal on line 39 by the signal on line 46, and the resultant product signal is applied to line 29. The outputs of multiplier 41 and multiplier 42 are summed on line 29 with the resultant signal being coupled to reverberator 31.

The output of reverberator 31, line 32, is applied to a highpass filter 48 (500Hz filter); the output of this highpass filter is coupled to the input of a 90° phase difference network 51, via line 49.

The 90° phase difference network 51 may be similar to the 90° phase network 37, and thus generates a signal on lead 53 which is 90° out of phase with the signal on line 52. However, network 51 operates in the frequency range 500 to 5000 Hz.

The multipliers 55 and 56 perform a substantially identical function to multipliers 41 and 42; in the case of multiplier 55, this means multiplies the signals on line 52 by the signal on line 46, with the resultant signal being coupled to line 58. Similarly, multiplier 56 multiplies the signal on line 53 by the signal on line 45 and applies the product signal to line 58. The output of the multipliers 55 and 56 are summed on line 58, and this sum signal is coupled to the highpass filter with notches 60.

A quadrature oscillator 44 is utilized for generating the carrier signal used within multipliers 41, 42, 55 and 56. In the presently preferred embodiment this oscillator generates a 4kHz signal which signal is coupled to line 45. A signal 90° out of phase with the signal applied to line 45 is coupled to line 46. Through use of a single quadrature oscillator 44 (for both the upwardly and downwardly frequency shifting) precise (and economical) frequency shifting is obtained, thus assuring exact reconstitution of the original frequencies.

Figure 3:
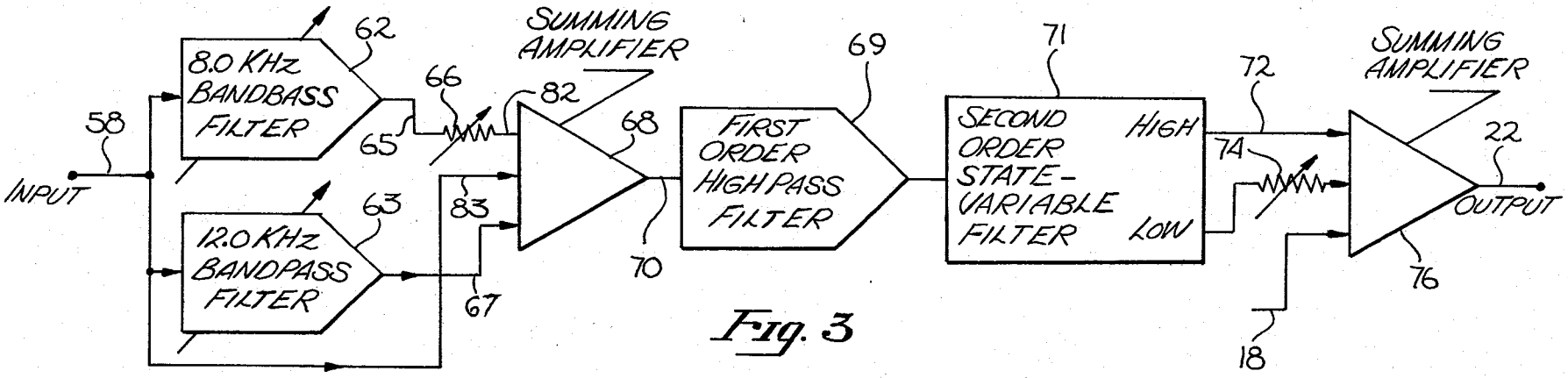
FIG. 3 is a detail block diagram of the highpass filter with notches shown in FIG. 2.

The highpass filter with notches 60 shall be described in conjunction with FIG. 3; however in general, this filter is utilized to reduce the spurious outputs of the frequency shifters such that these undesirable signals are masked by the wideband Gaussian noise inherent in electrical systems. Particularly, the filter 60 is used to attenuate the carrier frequency (4kHz) and its harmonics generated by multipliers 55 and 56, and unwanted sidebands It can be shown that the output of the modulators or multipliers 41 and 42, line 29, is the signal applied to line 26, shifted down in frequency by the frequency of the quadrature oscillator 44, which in the presently preferred embodiment is 4kHz. Thus, the input to reverberator 31 is in the range of approximately 500Hz to 5kHz, a range which may be successfully operated upon by the reverberator 31. Similarly, the output of the highpass filter 48 after passing through the network 51, and the multipliers 55 and 56 is shifted up to its previous range, since these means generate an upper sideband.

The frequency shifters generate certain undesirable signals which are eliminated by the highpass filter with notches 60. First, the carrier frequency of 4kHz generated by oscillator 44, and the harmonics of this signal, are present in both the downwardly shifted and upwardly shifted signals because of imperfections in multipliers 41, 42, 55 and 56. Moreover, both in the upward shifting and downward shifting, the unwanted sideband is nonetheless present, although typically it is 40db lower than the desired sideband. The harmonics of the carrier, and the unwanted sideband generated in the downward frequency shifting, when applied to the reverberator 31 are substantially attenuated because of the rapid cutoff of reverberator 31 above 5kHz, as previously discussed. However, the carrier frequency of 4kHz from the downward frequency shifting is shifted by the upward frequency shifting to 8kHz. Also, the third harmonic of the 4kHz carrier signal appears on line 58 because of leakage and imperfections in multipliers 55 and 56. This frequency is 12kHz.

Referring now to FIG. 3, the filter 60 of FIG. 2 includes an input line 58 which is coupled to the input terminal of an 8kHz bandpass filter 62, and to the input terminal of a 12kHz bandpass filter 63. The input line 58 is also coupled to one input terminal of a summing amplifier 68. The output of filter 62 is coupled to a gain control means 66, via line 65, and then to another input terminal of the summing amplifier 68, via line 82. The output of the filter 63 is coupled to the third input terminal of the summing amplifier 68 by a line 83. Both the filters 62 and 63 are second order bandpass filters with "Q's" approximately equal to 7.5, in the presently preferred embodiment. These filters provide a polarity reversal, and hence when their outputs are summed with the input signal on line 58, the resultant signal includes two high Q notches. Both filters 62 and 63 include tuning means to allow tuning of the filters; additionally, since the 8kHz component is substantially larger than the 12kHz component, the output of filter 62 may be controlled by gain control means 66 to provide a null for maximum rejection of the 8kHz signal. These filters may be tuned with a single rheostat in a multiple feedback configuration which permits such tuning which will be described in conjunction with FIG. 4.

The output of the summing amplifier 68, line 70, is coupled to a first order highpass filter 69. The output of filter 69 is applied to a second order state-variable filter 71 which includes a highpass output, line 72, and a lowpass output coupled to gain control means 74. By summing these outputs, and through use of the gain control means 74, a notch at 4kHz is obtained. The center frequency and Q of filter 71 is selected such that its response forms a third order elliptical function highpass response when it is cascaded with the first order highpass filter 69. Thus, the combination of filter 69 and 71, along with the summing that occurs within summing amplifier 22, filters out the 4kHz carrier signal, and provides further attenuation of the unwanted lower sideband resulting from the upward frequency shifting.

The summing amplifier 76 illustrated in FIG. 3 also sums the signal from the low frequency path, line 18 of FIG. 1, with the outputs from the filter 71 to provide the output signal on line 22.

Figure 4:
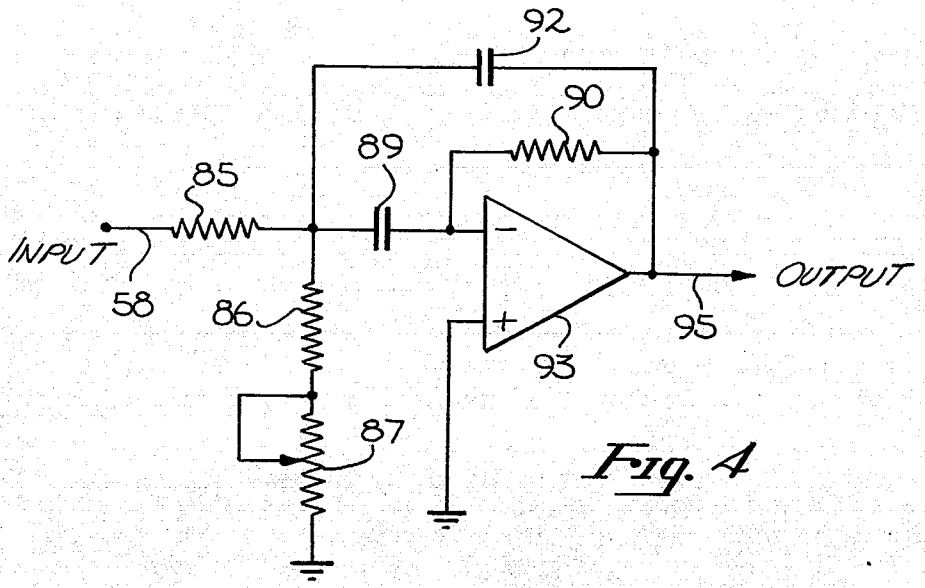
FIG. 4 is a detail circuit diagram illustrating the presently preferred embodiment for each of the bandpass filters shown in FIG. 3.

Referring now to FIG. 4 the presently preferred embodiment for filters 62 and 63 is illustrated. The circuit of FIG. 4 is utilized twice with different component values to realize filters 62 and 63. The circuit of FIG. 4 includes a resistor 85 coupled to the input line 58. Resistor 85 is also coupled to one terminal of capacitor 89, one terminal of the feedback capacitor 92, and one terminal of resistor 86. The other terminal of resistor 86 is coupled to ground through rheostat 87. The other terminal of capacitor 89 is coupled to the negative input terminal of a operational amplifier 93. This terminal of the amplifier is also coupled to the output line 95 through a feedback resistor 90. The positive terminal of the operational amplifier 93 is coupled to ground. When the circuit of FIG. 4 is used in the filter of FIG. 3, the line 95 is coupled to an input terminal of a summing amplifier, such as summing amplifier 68. The signal on line 95 corresponds to the signals on lines 65 and 67 of the embodiment illustrated in FIG. 3. Thus, a signal on line 95 is summed with the signal on line 58, and the resultant signal may be applied to the first order highpass filter 69. With the circuit of FIG. 4, both the 8kHz bandpass filter and the 12kHz bandpass filter may each be tuned with a single rheostat 87.

Figure 5:
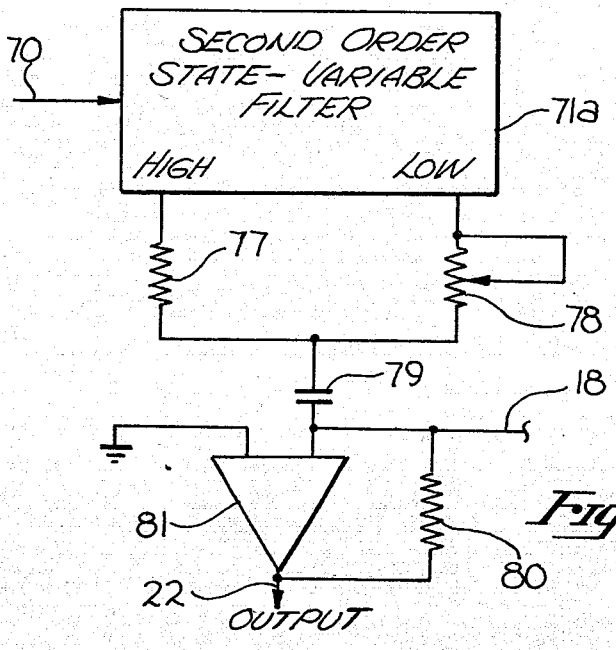
FIG. 5 is a detail circuit diagram illustrating an embodiment of a highpass filter and summing means employed in the filter of FIG. 3.

Referring to FIG. 5, an alternate means for summing the output of filter 71 of FIG. 3, and for realizing the first order highpass filter 69 of FIG. 3 is illustrated. The second order state-variable filter 71 of FIG. 3 is illustrated as filter **71*a* in FIG. 5; however, this filter may be the same as filter 71 of FIG. 3. The input to this filter is shown as line 70, the output of the summing amplifier 68 of FIG. 3. The first order highpass filter 69 of FIG. 3 is not used at the input to filter 71*a* for the embodiment of FIG. 5, since this filter is realized as capacitor 79 in conjunction with resistors 77 and 78, at the output of the filter 71*a*. The highpass terminal of filter 71*a* is coupled to one terminal of capacitor 79** through resistor 77, while the lowpass terminal of filter 71a is coupled to capacitor 79 through a rheostat 78. The other terminal of capacitor 79 is coupled to one input terminal of an operational amplifier 81. Also coupled to this terminal is line 18, this line being the low frequency path described in conjunction with FIG. 1. A feedback resistor 80 is coupled to the output line 22 of amplifier 81, and the input terminal of this amplifier. With the circuit of FIG. 5, the highpass filter 69 is realized as a single capacitor at the output of filter 71*a*.

Thus, a system has been described which allows low cost spring reverberators to be used in a reverberation system having an extended frequency range. While two reverberators are illustrated in the disclosed embodiment, along with a single downward frequency shifter and a single upward frequency shifter, it will be appreciated that any number of reverberators, and frequency shifters, may be used to extend the frequency range to any desired range, in any increments.

I claim:

1. A reverberation system for providing reverberation to an input signal comprising:

a first frequency shifting means for receiving said input signal and for frequency shifting said input signal to a lower frequency range;

a reverberation means for providing reverberation, coupled to said first frequency shifting means; and a second frequency shifting means for frequency shifting a signal to a higher frequency range, said second frequency shifting means being coupled to said reverberator means;

whereby an input signal may be shifted to a lower frequency range such that the new frequency band is compatible with said reverberator means, and whereby the output of said reverberator means may be shifted back to its original frequency band with reverberation from said reverberation means.

2. The system defined by claim 1 wherein said shift of frequency to said lower frequency range is equal in Hertz to said shift of frequency to said higher frequency range.

3. The system defined by claim 2 wherein said first frequency shifting means and second frequency shifting means employ amplitude modulated, single-sideband generation means.

4. The system defined by claim 3 wherein said single-sideband generation means of said first frequency shifting means comprises a first phase difference network coupled to a first pair of multipliers, and a quadrature oscillator having its outputs coupled to said first pair of multipliers.

5. The system defined by claim 4 wherein said single-sideband generation means of said second frequency shifting means comprises a second phase difference network coupled to a second pair of multipliers, said second pair of multipliers being coupled to the output of said quadrature oscillator.

6. The system defined by claim 5 including highpass filter means coupled to said second frequency shifting means.

7. The system defined by claim 6 wherein said highpass filter includes a notch at the frequency of operation of said oscillator.

8. A reverberation system for providing reverberations to an input signal comprising:

a low frequency signal path, said path including a first reverberator means coupled to receive said input signal;

a high frequency signal path for receiving said input signal, said high frequency path comprising:

1. a downward frequency shifting means for shifting the frequency band of said input signal downwardly in frequency by a predetermined amount;
2. a second reverberator means coupled to said downward frequency shifting means; and,
3. a upward frequency shifting means for shifting the frequency band of the output of said second reverberator means upwardly in frequency by said predetermined amount; and summing means coupled to said low and high frequency paths, for summing signals in said paths;

whereby the frequency response of said reverberation system is extended through frequency shifting.

9. The system defined by claim 8 wherein said input signal is applied to said high frequency path through a highpass filter.

10. The system defined by claim 8 wherein said downward and upward frequency shifting means each employ a 90° phase difference network and a pair of multiplication means for generation of a single-sideband signal.

11. The system defined by claim 9 wherein each of said pair of multiplication means are coupled to a single quadrature oscillator means.

12. The system defined by claim 8 wherein said high frequency path includes a state-variable filter having a highpass and lowpass output, and summing means for summing said highpass and lowpass outputs so as to define a filtering notch at approximately the frequency of operation of said quadrature oscillator.

13. The system defined by claim 12 including a first bandpass filter in said high frequency path, said filter for attenuating a frequency approximately equal to twice said frequency of operation of said quadrature oscillator.

14. The system defined by claim 13 including a second bandpass filter in said high frequency path, said filter for attenuating a frequency approximately equal to three-times said frequency of operation of said quadrature oscillator.

15. In a reverberation system employing a spring reverberator, an improvement for extending the frequency range of such spring reverberator comprising:

a downward frequency shifting means for shifting the frequency of an input signal to a lower frequency band, coupled to such spring reverberator; and an upward frequency shifting means for shifting the output signal from such spring reverberator to its original frequency band;

whereby the frequency response of such reverberator may be extented.

* * * * *

UNITED STATES PATENT AND TRADEMARK OFFICE

CERTIFICATE OF CORRECTION

PATENT NO. : 3,980,828

DATED : September 14, 1976

INVENTOR(S) : ROBERT A. ORBAN

It is certified that error appears in the above-identified patent and that said Letters Patent are hereby corrected as shown below:

Column 1, at the end of line 14 and beginning on line 15, the word "reverberation" should read --reverberative--.

Column 1, line 35, the word "reverberations" should read --reverberators--.

Column 3, line 18, "500Hz filter" should read --"500Hz highpass filter--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*